US005892490A

United States Patent [19]

Asakura et al.

[11] Patent Number: 5,892,490

[45] Date of Patent: Apr. 6, 1999

[54] MEANDER LINE ANTENNA

[75] Inventors: Kenji Asakura, Shiga-ken; Seiji Kanba, Otsu; Teruhisa Tsuru, Kameoka; Harufumi Mandai, Takatsuki, all of Japan

[73] Assignee: Murata Manufacturing Co., Ltd., Japan

[21] Appl. No.: 962,784

[22] Filed: Nov. 3, 1997

[30] Foreign Application Priority Data

Nov. 7, 1996 [JP] Japan ..... 8-295391

[51] Int. Cl.[6] ..... H01Q 1/36; H01Q 1/24

[52] U.S. Cl. ..... 343/895; 343/702; 343/873

[58] Field of Search ..... 343/895, 702, 343/787, 788, 718, 872, 873; H01Q 1/24, 11/08, 1/12, 1/36

[56] References Cited

U.S. PATENT DOCUMENTS 5,541,610 7/1996 Imanishi et al. ..... 343/895

5,592,184 1/1997 Cassel et al. ..... 343/895

5,767,811 6/1998 Mandai et al. ..... 343/895

*Primary Examiner*—Hoanganh Le

*Attorney, Agent, or Firm*—Ostrolenk, Faber, Gerb & Soffen, LLP

[57] ABSTRACT

A meander line antenna includes a rectangular-parallelopiped base member made from a dielectric material having barium oxide, aluminum oxide, and silica as main components, a meander-shaped conductor having, e.g., 10 corners made of copper or a copper alloy by printing, deposition, pasting, or plating inside the base member, and a power-feed terminal for applying a voltage to the conductor. The meander-shaped conductor is formed in the longitudinal direction of the base member. One end of the conductor is led to a surface of the base member to form a power-feed section and is connected to the power-feed terminal. The other end of the conductor serves as an open end inside the base member.

8 Claims, 3 Drawing Sheets

MEANDER LINE ANTENNA

BACKGROUND OF THE INVENTION

1. Field of the Invention

The present invention relates to a meander line antenna used for mobile communications and in local area network (LAN).

2. Description of the Related Art

FIG. 6 shows a monopole antenna 50, which is a conventional line-shaped antenna. The monopole antenna 50 has one conductor 52 almost upright against a ground surface 51 in the air (relative dielectric constant $\in=1$, relative magnetic permeability $\mu=1$). A power source V is connected to one end 53 of the conductor 52, and the other end 54 is free.

Since the conductor of a line-shaped antenna, typical of which is the above conventional monopole antenna, exists in the air, the dimensions thereof are large. Assuming that the wavelength of a signal in a vacuum is $\lambda_0$, for example, the conductor of a monopole antenna is required to have a length of $\lambda_0/4$. When the resonant frequency is 1.0 GHz or less, the conductor of a monopole antenna needs to be at least about 7.5 cm long.

Therefore, it is difficult to use a monopole antenna in a case in which a compact antenna is required, especially in low-frequency mobile communications.

SUMMARY OF THE INVENTION

The present invention has been made to solve this problem. Accordingly, it is an object of the present invention to provide a compact meander line antenna whose resonant frequency can be determined at a design stage.

The present invention provides a meander line antenna comprising: a base member made from at least one of a dielectric material and a magnetic material; and at least one meander-shaped conductor disposed at least one of on a surface of said base member and inside said base member; wherein the resonant frequency f1 of said meander line antenna satisfies the following equation when the resonant frequency f0 of a line-shaped antenna is expressed by $f0=(C/\in^{0.5})/(4\times L)$, where C is the speed of light, $\in$ is the dielectric constant of the base member, and L is the length of the conductor;

$$f1=A\times T^{0.5}\times f0$$

where $A=K/P^{0.5}-L/P+M$, T is the number of turns in said meander-shaped conductor, and K, L, and M are constants.

The above meander line antenna may further comprise at least one power-feed terminal disposed on a surface of said base member and connected to said conductor.

The present invention further provides a method of producing the above meander line antenna, comprising the steps of: preparing a base member made from at least one of a dielectric material and a magnetic material; and disposing at least one meander-shaped conductor on at least one of a surface of said base member and inside said base member; wherein the resonant frequency f1 of said meander line antenna is determined to satisfy the following equation when the resonant frequency f0 of a line-shaped antenna is expressed by $f0=(C/\in^{0.5})/(4\times L)$, where C is the speed of light, $\in$ is the dielectric constant of the base member, and L is the length of the conductor;

$$f1=A\times T^{0.5}\times f0$$

where $A=K/P^{0.5}-L/P+M$, T is the number of turns in said meander-shaped conductor, and K, L, and M are constants.

The above method may further comprise the step of: disposing at least one power-feed terminal on a surface of said base member so that the power-feed terminal is connected to said conductor.

According to a meander line antenna of the present invention, since a meander-shaped conductor is provided inside the base member or on a surface of the base member, or both, the base member being made from a dielectric material or a magnetic material, or both, the propagation speed is slow and the wavelength is reduced. Therefore, the effective line length of the conductor becomes larger by a factor of $1/\in^{0.5}$. In addition, the conductor has a meander shape. Hence, a compact meander line antenna is provided.

The resonant frequency f1 of the meander line antenna is determined when the interval P of facing line segments of the conductor and the number T of turns in the conductor are specified in the equations $f1=A\times T^{0.5}\times f0$, $f0=(C/\in^{0.5})/(4\times L)$, and $A=K/P^{0.5}-L/P+M$. Therefore, the detailed shape of the meander-shaped conductor required for obtaining the desired resonant frequency, that is the number T of turns in the conductor, the interval P between facing line segments in the conductor, and the length L of the conductor, can be easily determined at a design stage.

DESCRIPTION OF THE PREFERRED EMBODIMENTS

Figure 1:
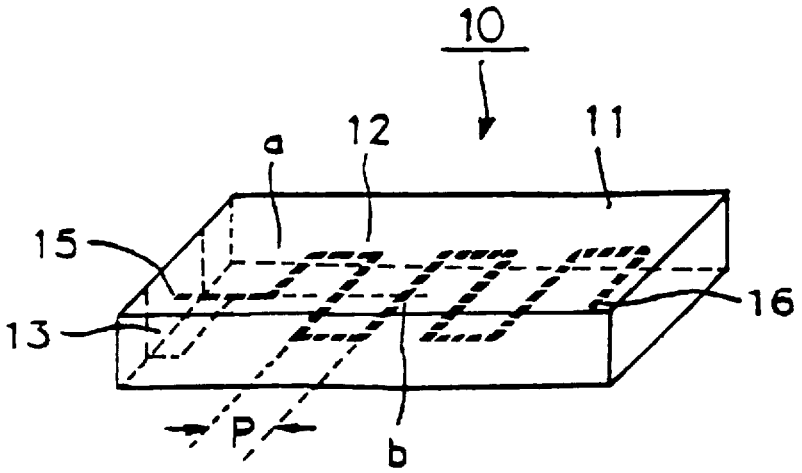
FIG. 1 is a perspective view of a meander line antenna according to a first embodiment of the present invention.

Embodiments of the present invention will be described below by referring to the drawings.

FIG. 1 is a perspective view of a meander line antenna according to a first embodiment of the present invention.

Figure 2:
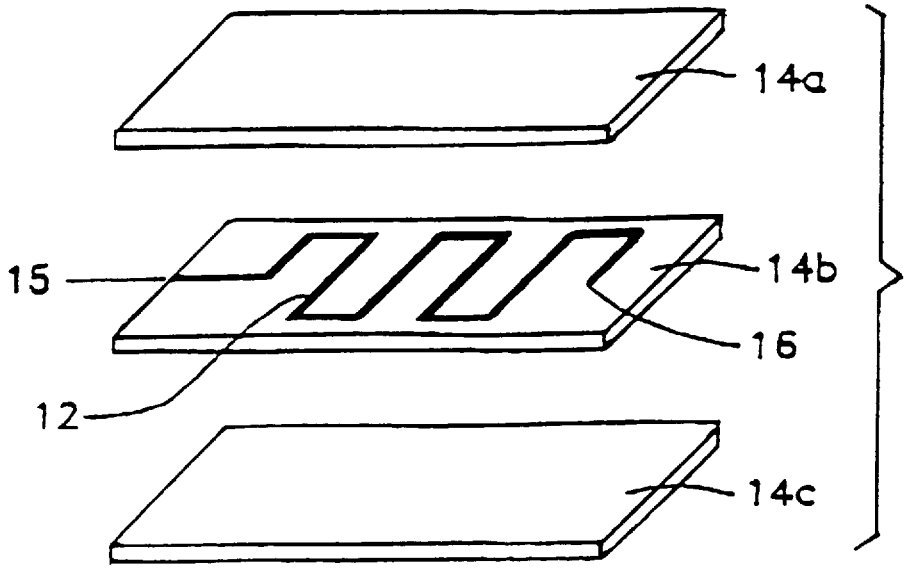
FIG. 2 is an exploded perspective view of the meander line antenna shown in FIG. 1.

FIG. 2 is an exploded perspective view of the antenna. A meander line antenna 10 includes a rectangular-parallelopiped base member 11, a meander-shaped conductor 12 disposed inside the base member 11 and having, e.g., 10 corners, and a power-feed terminal 13 disposed on a surface of the base member 11, for applying a voltage to the conductor 12.

The base member 11 is formed of rectangular sheet layers 14*a* to 14*c* made, e.g., from a dielectric material having barium oxide, aluminum oxide, and silica as main components. On a surface of the sheet layer 14*b*, the meander-shaped conductor 12 is formed of a conductive material, e.g., copper or a copper alloy, by printing, deposition, pasting, or plating. The sheet layers 14*a* to 14*c* are laminated to form the meander-shaped conductor 12 having 10 corners in the longitudinal direction of the base member 11 inside the base member 11.

One end of the conductor 12 is led to a surface of the base member 11 to form a power-feed section 15 and is connected to the power-feed terminal 13. The other end of the conductor 12 serves as an open end 16 inside the base member 11.

Figure 3:
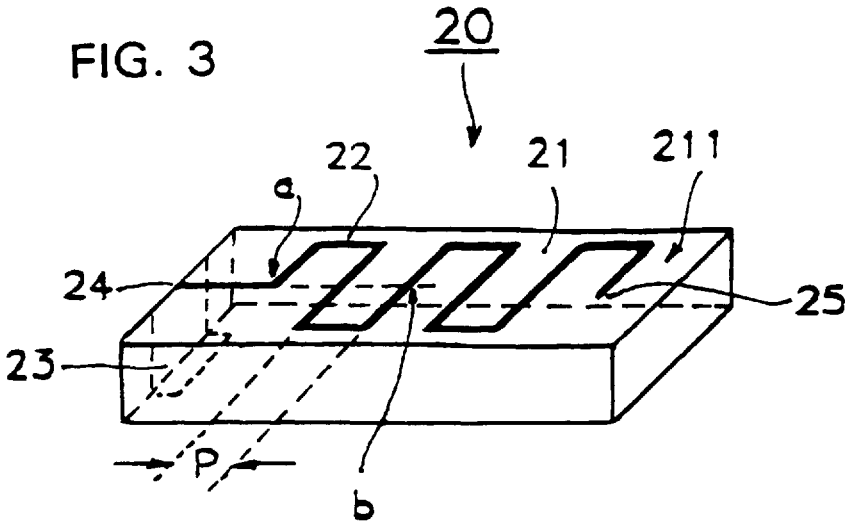
FIG. 3 is a perspective view of a meander line antenna according to a second embodiment of the present invention.

FIG. 3 is a perspective view of a meander line antenna according to a second embodiment of the present invention. The meander line antenna 20 differs from the meander line antenna 10 shown in FIG. 1 in that the meander-shaped conductor 22 is formed on one main surface of a base member.

The meander line antenna 20 includes a rectangular-parallelopiped base member 21 made, e.g., from a dielectric material having barium oxide, aluminum oxide, and silica as main components, a meander-shaped conductor 22 having, e.g., 10 corners made of a conductive material, e.g., copper or a copper alloy, on a main surface 211 of the base member 21 by printing, deposition, pasting, or plating, and a power-feed terminal 23 disposed on surfaces (the other main surface and a side face) of the base member 21, for applying a voltage to the conductor 22. The meander-shaped conductor 22 is formed from one end to the other opposing end of the main surface 211 of the base member 21. One end of the conductor 22 forms a power-feed section 24 and is connected to the power-feed terminal 23. The other end of the conductor 22 serves as an open end 25.

In FIGS. 1 and 3, let the length of the conductor 12 or 22 from the power-feed section 15 or 24 to the open end 16 or 25 be called the length L, the portion from point "a" to point "b" be called one turn of the conductor 12 or 22, and the interval between facing line segments in the conductor. 12 or 22 be called P.

Figure 4:
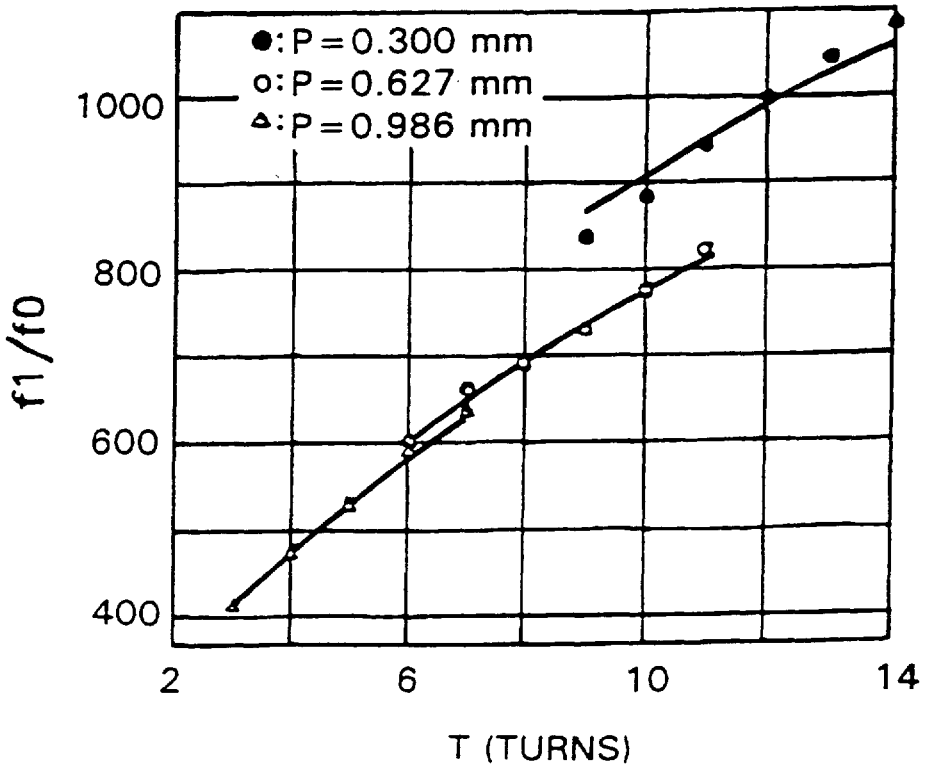
FIG. 4 shows the relationship between the number T of turns and the ratio f1/f0 of a measured resonant frequency f1 and a theoretical resonant frequency f0 of the meander line antennas shown in FIGS. 1 and 3.

FIG. 4 shows the relationship between the number T of turns in the conductor 12 or 22 and the ratio f1/f0 of the resonant frequency f1 of the meander line antenna 10 or 20 and the resonant frequency f0 of a monopole antenna 50, which is a line-shaped antenna, having the same line length L, with the interval P of facing line segments in the conductor 12 or 22 of the meander line antenna 10 or 20 being set to 0.3 mm, 0.627 mm, and 0.986 mm. It is understood from FIG. 4 that the relationship between the number T of turns in the conductor 12 or 22 and the resonant-frequency ratio f1/f0 is expressed by the following same regression equation even when the interval P of facing line segments in the conductor 12 or 22 varies.

$$f1/f0=A\times T^{0.5} \quad (1)$$

This equation can be expressed in the following way.

$$f1=A\times T^{0.5}\times f0 \quad (1')$$

The resonant frequency f0 of the monopole antenna 50 is expressed by the following equation.

$$f0=(C/\in^{0.5})/(4\times L) \quad (2)$$

Figure 5:
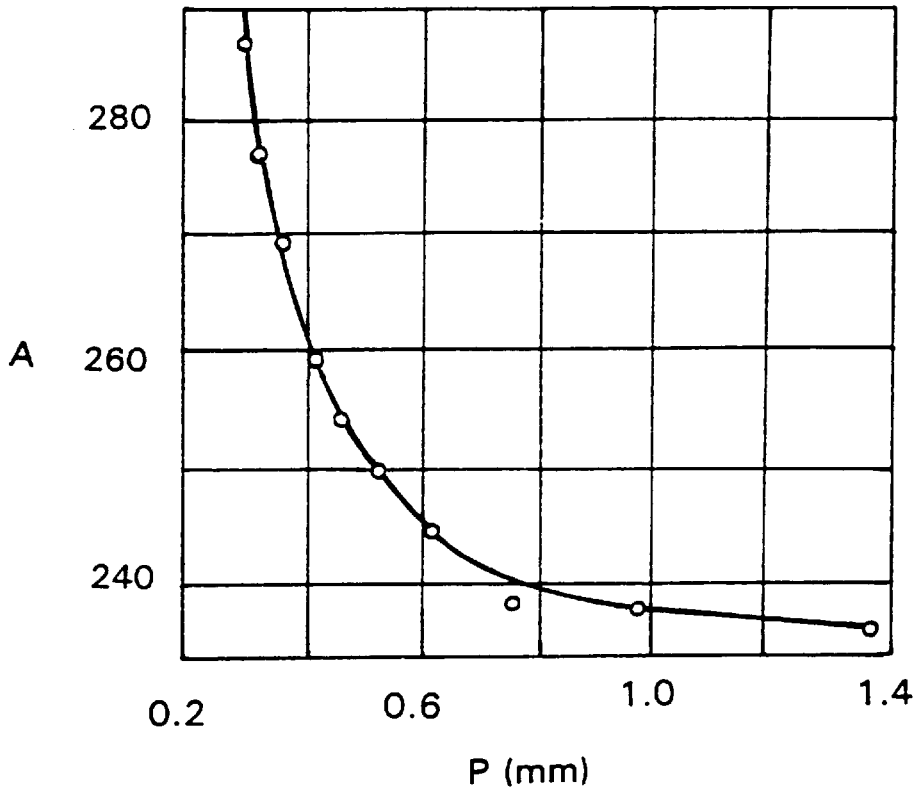
FIG. 5 shows the relationship between "A" in equation (1), described later, and the interval P of facing line segments of the conductor in the meander line antennas shown in FIGS. 1 and 3.
Figure 6:
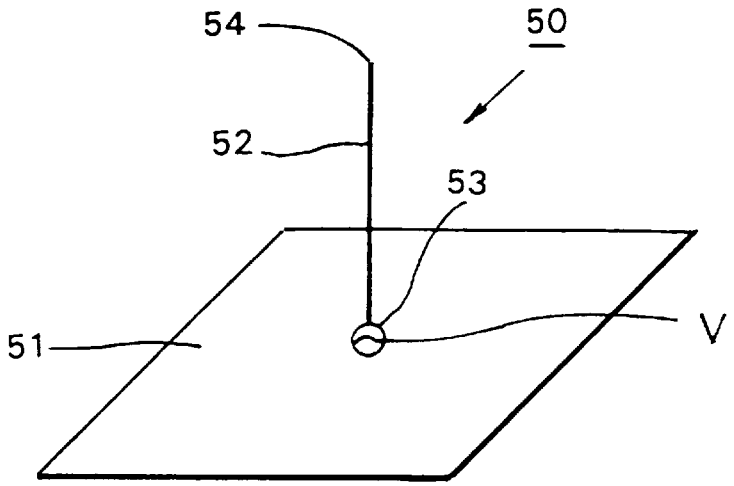
FIG. 6 PRIOR ART
FIG. 6 shows the structure of a conventional monopole antenna.

FIG. 5 shows the relationship between "A" in equation (1) and the interval P of facing line segments in the conductor 12 or 22 of the meander line antenna 10 or 20. It is understood from FIG. 5 that the relationship can be approximated by the following regression equation.

$$A=K/P^{0.5}-L/P+M \quad (3)$$

where K, L, and M are constants and in this case they are 5.818, 4.603, and 236.9, respectively.

According to the first and second embodiments, since the conductor is provided inside or on a surface of the base member made from a dielectric material, the propagation speed is slow and the wavelength is reduced. Therefore, the effective line length of the conductor becomes larger by a factor of $1/\in^{0.5}$. In addition, the conductor has a meander shape having, in the embodiment shown, 10 corners. Hence, a compact meander line antenna is provided.

The resonant frequency f1 of the meander line antenna can be obtained by substituting the values calculated from equations (2) and (3) for "A" and f0 in equation (1'). Therefore, the detailed shape of a meander-shaped conductor required for obtaining the desired resonant frequency, that is the number of turns in the conductor, the interval between facing line segments in the conductor, and the length of the conductor, can be easily determined in the design stage.

In the meander line antenna in each of the first and second embodiments, the base member is made from a dielectric material having barium oxide, aluminum oxide, and silica as main components. The material of the base member is not limited to this dielectric material. A dielectric material including titanium oxide and neodymium oxide as main components, a magnetic material having nickel, cobalt, and iron as main components, or a combination of a dielectric material and a magnetic material may be used.

In the above embodiments, one conductor is used. A plurality of conductors disposed in parallel may be provided. A plurality of power-feed terminals may also be provided on a surface of a base member according to the number of conductors. In this case, a plurality of resonant frequencies are provided according to the number of conductors, and one antenna can handle multiple bands.

In the above embodiments, the conductor is provided inside or on a surface of the base member. The conductor may be provided both inside and on a surface of the base member.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A meander line antenna comprising:

a base member comprising at least one of a dielectric material and a magnetic material; and at least one meander-shaped conductor disposed at least one of on a surface of said base member and inside said base member;

wherein the resonant frequency f1 of said meander line antenna satisfies the following equation when the resonant frequency f0 of a line-shaped antenna is expressed by $f0=(C/\in^{0.5})/(4\times L)$, where C is the speed of light, $\in$ is the dielectric constant of the base member, and L is the length of the conductor;

$$f1=A\times T^{0.5}\times f0$$

where $A=K/P^{0.5}-L/P+M$, T is the number of turns in said meander-shaped conductor, and K, L, and M are constants, and P is the interval between facing line segments in the conductor.

2. The meander line antenna of claim 1, further comprising;

at least one power-feed terminal disposed on a surface of said base member and connected to said conductor.

3. The meander line antenna of claim 2, wherein a second end of the conductor comprises a free end at least one of inside the base member or on the surface of the base member.

4. The meander line antenna of claim 1, wherein the conductor is disposed inside the base member and the base member comprises a plurality of laminated layers with said conductor being provided on at least one of said layers.

5. A method of producing a meander line antenna comprising the steps of:

preparing a base member comprising at least one of a dielectric material and a magnetic material; and disposing at least one meander-shaped conductor at least one of on a surface of said base member and inside said base member;

wherein the resonant frequency f1 of said meander line antenna is determined to satisfy the following equation when the resonant frequency f0 of a line-shaped antenna is expressed by $f0=(C/\in^{0.5})/(4\times L)$, where C is the speed of light, $\in$ is the dielectric constant of the base member, and L is the length of the conductor;

$$f1=A\times T^{0.5}\times f0$$

where $A=K/P^{0.5}-L/P+M$, T is the number of turns in said meander-shaped conductor, and K, L, and M are constants, and P is the interval between facing line segments in the conductor.

6. The method of claim 5, further comprising providing said base member as a plurality of laminated layers, with said conductor being disposed on at least one of said layers.

7. A method of producing a meander line antenna comprising the steps of:

preparing a base member comprising at least one of a dielectric material and a magnetic material;

disposing at least one meander-shaped conductor at least one of on a surface of said base member and inside said base member; and disposing at least one power-feed terminal on a surface of said base member so that the power-feed terminal is connected to said conductor;

wherein the resonant frequency f1 of said meander line antenna is determined to satisfy the following equation when the resonant frequency f0 of a line-shaped antenna is expressed by $f0=(C/\in^{0.5})/(4\times L)$, where C is the speed of light, $\in$ is the dielectric constant of the base member, and L is the length of the conductor;

$$f1=A\times T^{0.5}\times f0$$

where $A=K/P^{0.5}-L/P+M$, T is the number of turns in said meander-shaped conductor, and K, L, and M are constants, and P is the interval between facing line segments in the conductor.

8. The method of claim 7, further comprising providing said base member as a plurality of laminated layers, with said conductor being disposed on at least one of said layers.

* * * * *